US005226744A

United States Patent [19]

Kemmerer

[11] Patent Number: 5,226,744

[45] Date of Patent: Jul. 13, 1993

[54] COSMETIC PRODUCT SELF AGITATION CONTAINER

[75] Inventor: Walter K. Kemmerer, Cortlandt Manor, N.Y.

[73] Assignee: Risdon Corporation, Naugatuck, Conn.

[21] Appl. No.: 987,005

[22] Filed: Dec. 7, 1992

Related U.S. Application Data

[63] Continuation-in-part of Ser. No. 790,374, Nov. 12, 1991, abandoned.

[51] Int. Cl.[5] ..... A45D 40/00; A45D 40/02

[52] U.S. Cl. ..... 401/4; 401/122; 401/129; 132/218

[58] Field of Search ..... 132/218; 401/4, 121, 401/122, 129, 126; 220/695, 671

[56] References Cited

U.S. PATENT DOCUMENTS

| | | | |
|---|---|---|---|
| D. 285,732 | 8/1986 | Holloway | D28/85 |
| D. 304,095 | 10/1989 | Gavin | D28/7 |
| 326,949 | 9/1885 | Cahoone . | |
| 1,282,797 | 10/1918 | Fouts . | |
| 2,124,021 | 7/1938 | Akers | 220/90 |
| 2,988,767 | 6/1961 | Tretwold et al. | 15/257.06 |
| 2,990,834 | 7/1961 | Amen | 132/85 |
| 3,209,387 | 10/1965 | Lukesch | 15/510 |
| 3,214,782 | 11/1965 | Masters et al. | 15/521 |
| 3,336,624 | 8/1967 | Schefer et al. | 15/510 |
| 3,870,186 | 3/1975 | Reinhard | 220/212 |
| 3,930,280 | 1/1976 | Vasas | 15/257.05 |
| 4,802,797 | 2/1989 | Cole | 401/122 |
| 4,810,122 | 3/1989 | Cole | 401/122 |
| 4,886,387 | 12/1989 | Goldberg et al. | 401/122 |
| 4,921,366 | 5/1990 | Hurrell | 401/126 |
| 4,972,858 | 11/1990 | Beck et al. | 132/218 |

FOREIGN PATENT DOCUMENTS 2598299 5/1986 France .

*Primary Examiner*—Steven A. Bratlie

*Attorney, Agent, or Firm*—St. Onge Steward Johnston & Reens

[57] ABSTRACT

A cosmetic container is provided with at least two ribs along its inner walls that extend inwardly so that an applicator such as a mascara brush contacts the ribs. This divides the container into at least two chambers defined by the rib and brush. Unscrewing the container cap causes agitation, mixing and stirring of the cosmetic product in the chambers by the flexing snapping action of the applicator brush against the ribs stirring up the product contained in the chambers. This provides an improved cosmetic product that has a consistent viscosity and color so that it can be applied more uniformly.

19 Claims, 2 Drawing Sheets

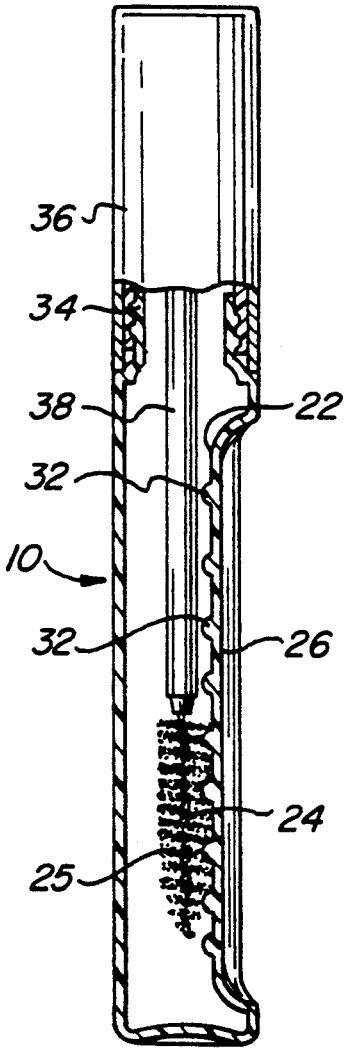
FIG. 7
FIG. 9
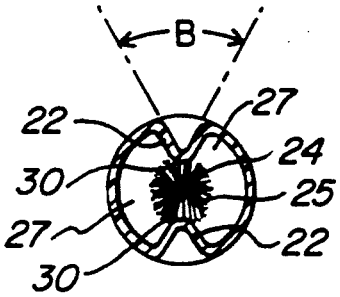
FIG. 11
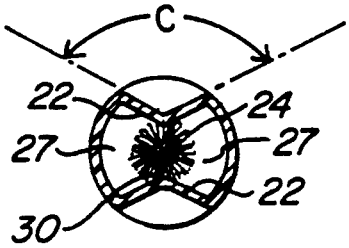
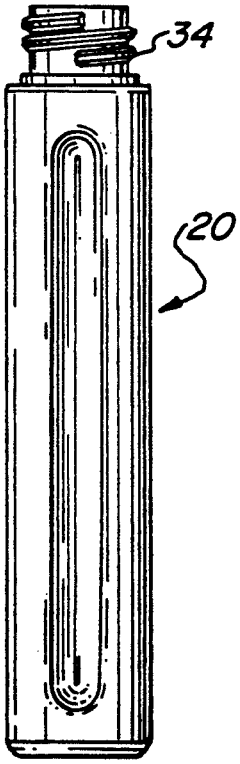
FIG. 8
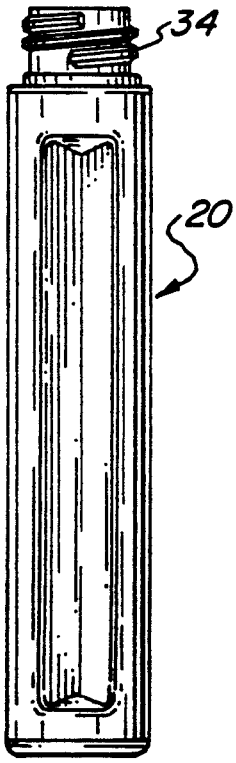
FIG. 10

COSMETIC PRODUCT SELF AGITATION CONTAINER

This application is a continuation-in-part under 35 U.S.C. §120 of copending U.S. patent application Ser. No. 07/790,374 filed Nov. 12, 1991 in the name of Walter K. Kemmerer entitled "Cosmetic Product Self Agitation Container" now abandoned.

FIELD OF THE INVENTION

The present invention relates to the field of containers, packaging and applicators for cosmetics, and particularly, but not exclusively, to containers for cosmetics incorporating tinting or coloring materials such as a pigment together with a more volatile solvent, for example, mascara and lipgloss.

BACKGROUND OF THE INVENTION

Cosmetics such as mascara and lipgloss often comprise a pigment suspended in a water based solvent. It is desirable to thoroughly mix the pigment and solvent in a cosmetic container prior to use to insure a color and application consistency. It is also desirable to stir the contents of the container to reduce waste; otherwise there can be an accumulation of unused pigment at the bottom of the container which can thicken and harden so that it becomes unusable.

A consumer can shake the container containing the cosmetic. However, the consumer often forgets to do this.

It would be desirable to provide a cosmetic container that agitated the cosmetic prior to application without requiring the consumer to remember to do so.

SUMMARY OF THE INVENTION

It is an object of the invention to provide a cosmetic product self agitation container that provides product mixing automatically upon the removal of the container cap. It is an object of the invention to provide such a container which is easily manufactured and which has substantial aesthetic appeal to the consumer.

In accordance with one embodiment of the invention, a cosmetic product self agitation container comprises a bottle having a plurality of inwardly directed axial ribs integrally formed with the bottle which are sized to extend inwardly sufficiently so that an applicator, such as a mascara brush placed within the bottle, can press against the ribs during rotation of the applicator to thereby agitate a cosmetic product contained in the bottle. Preferably, the ribs are formed from the bottle wall so that there are indentations in the outer wall of the bottle that correspond to the ribs in the inner wall of the bottle. The ribs preferably have generally triangular cross-sections having peaks. The applicator has a plurality of bristles and the ribs contact the bristles and thereby define a plurality of separate mixing chambers in the bottle. Rotation of the bottle cap to remove it from the bottle causes the bristles to bear against and resiliently snap free from the ribs and thereby agitate material contained in said bottle to cause effective mixing of the material within the confinement of each separate chamber. This provides an improved cosmetic product that has a consistent viscosity and color so that it can be applied more uniformly. In addition, the ribs will assist to remove accumulated product from the applicator after use when the applicator is replaced in the bottle and rotated by the closing of the bottle.

In one preferred embodiment, there are three equidistantly spaced ribs, and the peaks of the triangular cross-sections have an angle of between about 45 degrees to about 120 degrees, most preferably about 90 degrees.

In another preferred embodiment, there are two oppositely located ribs, and the peaks of the triangular cross-sections have an angle of between about 45 degrees to about 135 degrees, most preferably about 60, 90, or 120 degrees.

Other objects, aspects and features of the present invention in addition to those mentioned above will be pointed out in or will be understood from the following detailed description provided in conjunction with the accompanying drawings.

BRIEF DESCRIPTION OF THE DRAWINGS

FIG. 7 is a cross-section of the container of FIG. 1 showing an applicator.

FIG. 8 is a front elevation view of another embodiment of a container in accordance with the invention.

FIG. 9 is a horizontal cross-section of the container of FIG. 8 showing an applicator.

FIG. 10 is a front elevation view of another embodiment of a container in accordance with the invention.

FIG. 11 is a horizontal cross-section of the container of FIG. 10 showing an applicator.

DESCRIPTION OF THE PREFERRED EMBODIMENT

Figure 1:
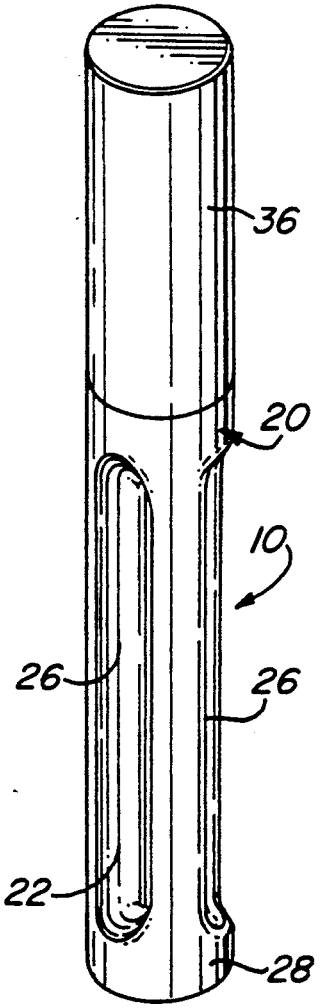
FIG. 1 is a perspective view of an embodiment of a cosmetic product self agitation container in accordance with the invention.
Figure 2:
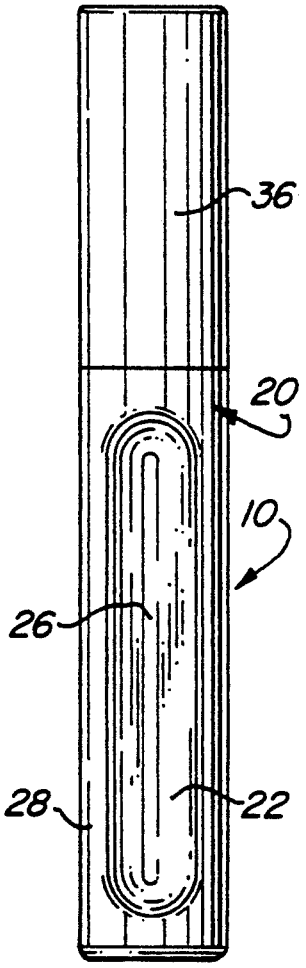
FIG. 2 is a front elevation view of the container of FIG. 1.
Figure 3:
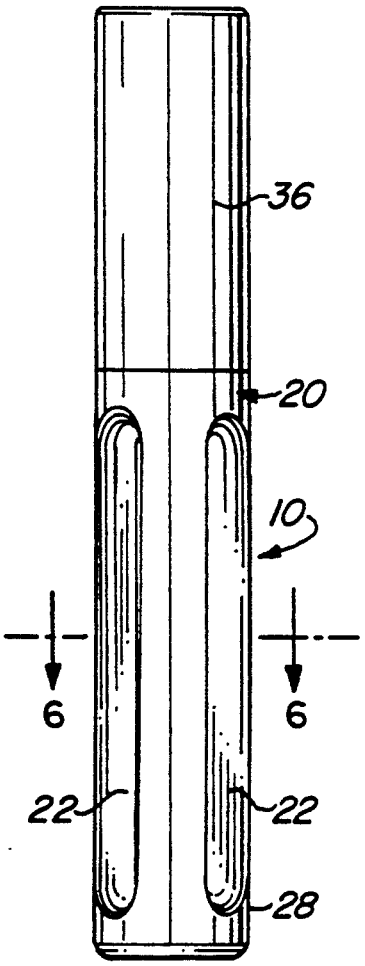
FIG. 3 is a rear elevation view of the container of FIG. 1.
Figure 6:
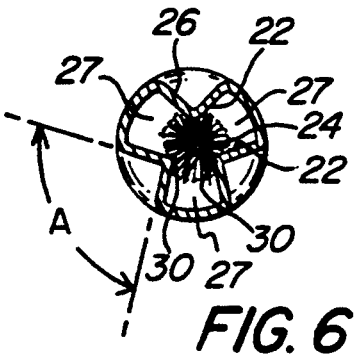
FIG. 6 is a cross-section of the container of FIG. 1 along the line 6—6 of FIG. 3.
Figure 4:
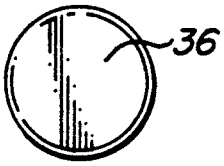
FIG. 4 is a top plan view of the container of FIG. 1.
Figure 5:
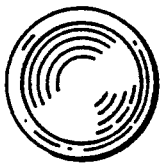
FIG. 5 is a bottom plan view of the container of FIG. 1.

Referring now to FIGS. 1–11, a cosmetic product self agitation container 10 is shown. Container 10 comprises a bottle 20 having a plurality of inwardly directed axial ribs 22 integrally formed with the bottle 20. Ribs 22 are sized to extend inwardly sufficiently so that an applicator 24 having a plurality of brush elements such as a mascara brush having a plurality of bristles placed within the bottle 20 can press against the ribs 22 during rotation of the applicator 24 to thereby agitate a cosmetic product contained in the bottle. Preferably, the ribs 22 are formed from the bottle wall so that there are indentations 26 in the outer wall 28 of the bottle 20 that correspond to the ribs 22 in the inner wall of the bottle 20. The ribs 22 preferably have generally triangular cross-sections having peaks 30 at their innermost surfaces. Alternatively, ribs 22 may have semi-circular or semi-elliptical cross-sections. Preferably, there are a plurality of inwardly extending embossments 32 on such peaks 30 to enhance agitation as is discussed hereafter.

FIGS. 1–7 show one preferred embodiment in which there are three equidistantly spaced ribs 22. Ribs 22 are located about 120 degrees apart from each other. The peaks 30 of the triangular cross-sections of ribs 22 have an angle A of between about 45 degrees to about 120 degrees. Most preferably the peaks 30 of the triangular cross-sections of ribs 22 have an angle A of about 90 degrees. It is to be appreciated that peaks 30 may be rounded or sharper edged. As can be seen in the FIGS., a rounded peak is preferred.

FIGS. 8–11 show another preferred embodiment of the bottle 20 having two oppositely located ribs 22. Preferably, the peaks 30 of the triangular cross-sections of the two ribs 22 have an angle of between about 45 degrees to about 135 degrees, and most preferably about 60, 90, or 120 degrees. Referring to FIGS. 8 and 9, one such preferred embodiment having a peak 30 angle B of about 60 degrees is shown. Referring to FIGS. 10 and 11, another such preferred embodiment having a peak 30 angle C of about 120 degrees is shown.

Referring again to all of the FIGS. 1–11, the bottle 20 has a mouth 34 for receiving the applicator 24 and has means for engagement and disengagement of a bottle cap 36 by rotation. Such means will typically comprise a neck having a screw thread located on the upper end of bottle 20 which mates with a mating screw thread formed inside of the cap 36. The applicator 24 is preferably affixed to the cap 36 by a stem 38 or by twisted wire strands. A plurality of bristles 25 of applicator 24 contact the ribs 22 and thereby define a plurality of separate mixing chambers 27 in the bottle. Rotation of the bottle cap 36 to remove it from the bottle 20 causes the bristles 25 to bear against and resiliently snap free from the ribs 22 and thereby agitate material contained in the bottle 20 to cause effective mixing of the material within the confinement of each separate chamber 27. This provides an improved cosmetic product that has a consistent viscosity and color so that it can be applied more uniformly.

In addition, the ribs 22 will assist to remove accumulated cosmetic product from the applicator 24 after use of the cosmetic product when the applicator 24 is replaced in the bottle 20 and rotated by the engagement of the cap 36 onto the bottle 20. The above stirring and applicator cleaning functions are enhanced by the embossments 32 that enhance the effect of the ribs 22.

Therefore, the present invention provides an improved cosmetic product self agitation container that agitates, mixes, and stirs the cosmetic product before use to provide a consistent product application.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A cosmetic product self agitation container, comprising:

a bottle having a mouth for receiving an applicator, and having a plurality of radially inwardly extending axial ribs located on an inner bottle wall of said bottle apart from said mouth, said applicator being affixed to a bottle cap and having a plurality of brush elements extending radially outwardly from an axis of said applicator, said ribs extending inwardly sufficiently whereby the ribs contact the brush elements and thereby define a plurality of separate mixing chambers in said bottle, said mouth of said bottle having means for engagement and disengagement of the bottle cap by rotation, whereby rotation of the bottle cap during disengagement of the bottle cap from the bottle causes said brush elements to bear against and resiliently snap free from said ribs and thereby agitate a material contained in said bottle, and wherein effective mixing of said material occurs generally within the confinement of said separate chambers.

2. A cosmetic product self agitation container in accordance with claim 1, wherein said bottle has an outer wall, and there is an indentation in said outer wall of said bottle corresponding to each said rib.

3. A cosmetic product self agitation container in accordance with claim 1, wherein there are two said ribs integrally formed with said bottle.

4. A cosmetic product self agitation container in accordance with claim 3, wherein said two ribs are located on two opposite sides of said bottle.

5. A cosmetic product self agitation container in accordance with claim 4, wherein said two ribs have generally triangular cross-sections having peaks, said peaks of said triangular cross-sections having an angle of between about 45 degrees to about 135 degrees.

6. A cosmetic product self agitation container in accordance with claim 1, wherein there are three said ribs integrally formed with said bottle.

7. A cosmetic product self agitation container in accordance with claim 6, wherein said three ribs are located equidistantly in said bottle.

8. A cosmetic product self agitation container in accordance with claim 7, wherein said three ribs have generally triangular cross-sections having peaks, and said peaks of said triangular cross-sections have an angle of between about 45 degrees to about 120 degrees.

9. A cosmetic product self agitation container, comprising:

a bottle having a mouth, a base and bottle walls extending therebetween, and three equidistantly spaced inwardly directed rigid axial ribs integrally formed with said walls of said bottle, said bottle having indentations corresponding to said ribs in an outer wall of said bottle, said ribs having generally triangular cross-sections having peaks, and said peaks of said triangular cross-sections have an angle of between about 45 degrees to about 120 degrees, an applicator being affixed to a bottle cap and having a plurality of bristles and being fittable into said bottle, said bottle having means for engagement and disengagement of the bottle cap by rotation, said ribs extending radially inwardly and said bristles extending radially outwardly from said applicator sufficiently whereby the ribs contact the bristles to define three separate chambers in said bottle when said bottle cap is engaged with said bottle, whereby rotation of the bottle cap to disengage the bottle cap from the bottle causes said bristles to bear against and resiliently snap free from said ribs and thereby agitate a material contained in said bottle, and wherein effective mixing of said material occurs generally within the confinement of each said separate chamber.

10. A cosmetic product self agitation container in accordance with claim 9, wherein said peaks of said triangular cross-sections have an angle of about 60 degrees.

11. A cosmetic product self agitation container in accordance with claim 9, wherein said peaks of said triangular cross-sections have an angle of about 90 degrees.

12. A cosmetic product self agitation container in accordance with claim 9, wherein said peaks of said triangular cross-sections have an angle of about 120 degrees.

13. A cosmetic product self agitation container in accordance with claim 9, further comprising a plurality of inwardly directed embossments located upon each said rib upon a middle axis thereof.

14. A cosmetic product self agitation container, comprising:

a bottle having a mouth, a base and bottle walls extending therebetween, and two equidistantly spaced inwardly directed rigid axial ribs integrally formed with said walls of said bottle, said bottle having indentations corresponding to said ribs in an outer wall of said bottle, said ribs having generally triangular cross-sections having peaks, and said peaks of said triangular cross-sections have an angle of between about 45 degrees to about 135 degrees, an applicator for fitting in said bottle being affixed to a bottle cap and having a plurality of bristles extending radially outwardly from an axis of said applicator, said bottle having means for engagement and disengagement of the bottle cap by rotation, said ribs extending inwardly and said bristles extending outwardly sufficiently whereby the ribs contact the bristles to define two separate chambers in said bottle when said bottle cap is engaged with said bottle, whereby rotation of the bottle cap to disengage the bottle cap from the bottle causes said bristles to bear against and resiliently snap free from said ribs and thereby agitate a material contained in said bottle, and wherein effective mixing of said material occurs generally within the confinement of each said separate chamber.

15. A cosmetic product self agitation container in accordance with claim 14, wherein said peaks of said triangular cross-sections have an angle of between about 60 to about 120 degrees.

16. A cosmetic product self agitation container in accordance with claim 15, wherein said peaks of said triangular cross-sections have an angle of about 60 degrees.

17. A cosmetic product self agitation container in accordance with claim 15, wherein said peaks of said triangular cross-sections have an angle of about 90 degrees.

18. A cosmetic product self agitation container in accordance with claim 15, wherein said peaks of said triangular cross-sections have an angle of about 120 degrees.

19. A cosmetic product self agitation container in accordance with claim 14, further comprising a plurality of inwardly directed embossments located upon each said rib upon a middle axis thereof.

* * * * *